US008394264B2

(12) United States Patent
Sappok et al.

(10) Patent No.: US 8,394,264 B2
(45) Date of Patent: Mar. 12, 2013

(54) METHOD FOR STABILIZING HEATING OIL OR DIESEL OIL, PARTICULARLY HEATING OIL OR DIESEL OIL FROM THE DEPOLYMERIZATION OF HYDROCARBON-CONTAINING RESIDUES, OR PYROLYSIS OIL

(75) Inventors: Manfred Sappok, Toenisvorst (DE); Dieter Wagels, Gellenkirchen (DE)

(73) Assignee: Dieter Wagels, Geilenkirchen (DE)

( * ) Notice: Subject to any disclaimer, the term of this patent is extended or adjusted under 35 U.S.C. 154(b) by 408 days.

(21) Appl. No.: 12/168,172

(22) Filed: Jul. 7, 2008

(65) Prior Publication Data

US 2009/0008296 A1 Jan. 8, 2009

(30) Foreign Application Priority Data

Jul. 5, 2007 (DE) ..... 10 2007 031 461

(51) Int. Cl.
*B01D 3/34* (2006.01)

(52) U.S. Cl. ..... 208/362

(58) Field of Classification Search ..... 208/177, 208/308, 347, 362
See application file for complete search history.

(56) References Cited

U.S. PATENT DOCUMENTS

| | | | | | |
|---|---|---|---|---|---|
| 1,797,513 | A | * | 3/1931 | Osterstrom et al. | 208/260 |
| 1,823,994 | A | * | 9/1931 | Strafford | 208/278 |
| 1,927,823 | A | * | 9/1933 | Davis et al. | 208/3 |
| 1,974,301 | A | * | 9/1934 | Egloff | 208/7 |
| 2,056,978 | A | * | 10/1936 | Osterstrom | 208/261 |
| 3,091,587 | A | * | 5/1963 | Klass et al. | 208/293 |
| 3,597,173 | A | * | 8/1971 | Wallace et al. | 208/255 |
| 4,222,884 | A | | 9/1980 | Malec | |

FOREIGN PATENT DOCUMENTS

| | | |
|---|---|---|
| CA | 2010183 | 2/1990 |
| DE | U 2769 | 5/1954 |
| DE | 2948764 C2 | 4/1979 |
| DE | 69001266 T2 | 2/1990 |
| DE | 10 2005 010 151 B3 | 2/2005 |
| WO | WO 2006/092306 A1 | 9/2006 |

OTHER PUBLICATIONS

Organic synthesis at high temperatures: Gas Phase—Flow Thermolysis by Martin Karpf (1986).

* cited by examiner

*Primary Examiner* — Randy Boyer
(74) *Attorney, Agent, or Firm* — Fay Sharpe LLP; Brian E. Turung

(57) ABSTRACT

In order to keep diesel or heating oil obtained by fractional distillation, in particular after depolymerization of residues, or pyrolysis oil that was obtained by pyrolysis of rubber or organic substances, permanently clear and light, first, the process of discoloration (darkening) is allowed and then a second distillation is carried out, through which a permanently clear and light heating, diesel or heavy oil is obtained.

10 Claims, No Drawings

METHOD FOR STABILIZING HEATING OIL OR DIESEL OIL, PARTICULARLY HEATING OIL OR DIESEL OIL FROM THE DEPOLYMERIZATION OF HYDROCARBON-CONTAINING RESIDUES, OR PYROLYSIS OIL

This application claims priority to German patent application No. DE 10 2007 031 461.4, filed Jul. 5, 2007, the entirety of which is hereby incorporated by reference as if fully set forth herein.

FIELD OF THE INVENTION

The invention concerns a method for stabilizing heating oil and diesel oil. Accordingly, the invention initially concerns a method for stabilizing heating oil and diesel oil that was obtained by fractional distillation, in particular after depolymerization of hydrocarbon-containing residues. In addition, the method is used to stabilize pyrolysis oils so that, after the stabilization process they can be used as fuel in equipment (machines) run on heavy oil.

PRIOR ART

Heating oil and diesel oil obtained by depolymerization of hydrocarbon-containing residues are known from DE 10 2005 010 151 B3. The depolymerization of the hydrocarbon-containing raw materials takes place by injecting the raw material, such as plastics or spent oil, as a liquid or slurry in a preheated state under pressure into a reactor heated to the cleavage temperature. A vapor fraction is taken from the reactor, which is heated indirectly via the jacket surface to an internal temperature of 420° C., for example, and a diesel or heating oil fraction is obtained directly from said vapor fraction by fractional distillation. The solid matter accumulating in the reactor is continuously removed and processed further. It turned out that, in particular, when this method is used to obtain heating oil and diesel oil, an initially very clear product results, but after some time, it becomes discolored until it is almost black. This does not adversely affect its ability to be used as a diesel or heating fuel, but nevertheless such discoloration of the product is not accepted by the consumer.

Motor oils also show an increase of viscosity due to "oil oxidation," which may also be connected with a darkening of color, but for which there is no oil treatment. Rather, replacement of the thus altered oil is common practice. In the case of motor fuels, especially if they are produced by cracking or pyrolysis, storage stability can be improved by adding antioxidants, such as are known under the trade name "Kerobit" from BASF. Through this, the polymerization reactions favored by free radicals at the ends of the hydrocarbon chains are said to be suppressed. However, such additives are for the most part hazardous to health.

A pyrolysis oil is produced in the pyrolysis of rubber and other renewable raw materials, in particular. Pyrolysis is understood to mean the heating of organic substances under exclusion of oxygen. M. Krapf distinguishes pyrolysis from thermolysis in *Z. Angew. Chemie* 1986; 98: 413-429. In the case of the so-called high temperature pyrolysis, the pyrolysis process takes place at temperatures between 600° C. and 800° C. The resulting product oil (pyrolysis oil) has the same problem as products obtained by depolymerization, since the pyrolysis product also turns a dark color due to the presence of unsaturated hydrocarbons. To make it suitable for use in heavy-oil engines, another process step is necessary.

Presentation of the Invention

Taking that as a starting point, the invention is based on the task of removing, in a simple way, the dark discoloration of diesel and heating oil, especially if the oil was obtained by depolymerization of hydrocarbon-containing residues, or from pyrolysis oil. In particular, expensive hydrogenation processes are to be avoided. To solve this task, it is proposed first to permit or promote a dark discoloration of the diesel/heating oil or pyrolysis oil (hereinafter jointly also called "starting oil"), in particular with the admission of oxygen, and then to subject the dark-colored starting oil to distillation or redistillation (hereinafter also called "decolorizing distillation"). It was established that a light and clear product without cloudiness results from this method and this product remains clear and light for a long time. The property requirements of diesel fuel according to DIN EN 590 and those for heating oil according to DIN 51603/1 could be achieved in this way, provided the sulfur had been reduced to the appropriate levels.

The process of dark discoloration of the starting oil can be largely suppressed or greatly slowed if the starting oil is stored, for example, under a protective gas and/or in the dark in a tank, preferably under exclusion of air and at temperatures that are not too high. The aging—or discoloration—process then progresses only extremely slowly, or is checked. If air, for example, is allowed to get into a starting oil tank, it can take a few weeks, for example, 2 or 3 weeks, for an obvious change of color to begin. Thus, it can be meaningful to store the freshly prepared starting oil in an appropriate way in order to delay the aging process.

To speed up the treatment of the starting oil in accordance with the invention, an oxidative treatment is carried out, for example with air. If the starting oil is bubbled with air, for example, the dark discoloration can begin in a few seconds.

The decolorizing distillation can be carried out in a conventional distillation column or in a so-called thin-layer evaporator. In the decolorizing distillation the discolored starting oil is heated to a temperature between 350 and 390° C., preferably to 360-380° C., and distilled at about 280-320° C., preferably 290-310° C. In thin-layer evaporation the discolored starting oil is passed as a thin layer over an evaporation surface heated to about 180-240° C., preferably 200-230° C., in a thin-layer evaporator that is preferably held at reduced pressure, and then the vapor component of the product is condensed, in particular as diesel or heating oil. Thin-layer evaporation takes place at a pressure of about 1-500 mbar, preferably 2-100 mbar (absolute).

Among other things, unexpectedly high amounts of the discolored starting oil can be obtained as a permanently clear product by means of the invention.

The same procedure with the same process parameters can therefore also be employed both in the decolorizing of diesel or heating oil and also in the decolorizing or purification of pyrolysis oil; in the case of the latter, a clear color is also achieved and the useful product thus produced can be used in internal combustion engines. It remains clear permanently.

Said components, the claimed components and those described in the embodiment examples that are to be used in accordance with the invention, are not subject to any particular exceptional conditions with regard to their size, shape, material choice and technical concept, as well as the other process conditions, so that the selection criteria known in the field of use can find unrestricted application.

Further details, characteristics and advantages of the object of the invention result from the following description of an embodiment example for heating oil obtained by depolymerization followed by bidistillation by thin-layer evaporation. In summary, the present invention is directed to a method for stabilizing heating oil and diesel oil obtained by fractional distillation or pyrolysis oil obtained by pyrolysis of rubber or organic substances, wherein initially a dark discoloration of the diesel oil, heating oil or pyrolysis oil is allowed or promoted and then the discolored diesel oil, heating oil or pyrolysis oil is subjected to a distillation step with elimination of the dark color. In one non-limiting embodiment, the heating oil or diesel oil to be stabilized is obtained by fractional distillation of the vapor phase from a process of depolymerization of hydrocarbon-containing residues. In another non-limiting embodiment, the dark discoloration is delayed or checked during an intermediate storage phase before the distillation of the heating, diesel or pyrolysis oil that removes the dark color, by preventing the admission of light and/or air or by storage under a protective gas atmosphere. In another non-limiting embodiment, the treatment of the heating, diesel or pyrolysis oil under an oxidative atmosphere, especially with oxygen, takes place before the distillation that removes the dark discoloration. In another non-limiting embodiment, during the dark-color phase the heating oil, diesel oil or pyrolysis oil is subjected to intensive agitation, for example, bubbling, with at least one oxidative fluid. In another non-limiting embodiment, the distillation that removes the dark discoloration is carried out in a distillation column or in a thin-layer evaporator. In another non-limiting embodiment, the discolored heating, diesel or pyrolysis oil is heated to a temperature between 350 and 390° C. and distilled at about 280-320° C. In another non-limiting embodiment, the discolored heating, diesel or pyrolysis oil is passed as a thin layer over an evaporator surface that is at about 180-240° C. in a thin-layer evaporator and then the vapor component that forms is condensed as diesel, heating or heavy oil. In another non-limiting embodiment, the thin-layer evaporation takes place at a pressure of about 1-500 mbar absolute. In another non-limiting embodiment, the discolored heating, diesel or pyrolysis oil is heated to a temperature of 360-380° C. and distilled at about 280-320° C. In another non-limiting embodiment, the discolored heating, diesel or pyrolysis oil is distilled at about 290-310° C. In another non-limiting embodiment, the discolored heating, diesel or pyrolysis oil is heated to a temperature between 350 and 390° C. and distilled at about 290-310° C. In another non-limiting embodiment, the discolored heating, diesel or pyrolysis oil is passed as a thin layer over the evaporator surface that is at about 200-230° C. in the thin-layer evaporator. In another non-limiting embodiment, the discolored heating, diesel or pyrolysis oil is passed as a thin layer over the evaporator surface that is at about 200-230° C. in the thin-layer evaporator that is held at reduced pressure. In another non-limiting embodiment, the discolored heating, diesel or pyrolysis oil is passed as a thin layer over the evaporator surface that is at about 180-240° C. in the thin-layer evaporator that is held at reduced pressure. In another non-limiting embodiment, the thin-layer evaporation takes place at a pressure of about 2-100 mbar absolute.

EMBODIMENT EXAMPLE

A discolored heating oil obtained from spent oil in accordance with DE 10 2005 010 151 B3 was evaporated in a VDL 70 thin-layer evaporator with 4 $dm^2$ WRS at 210° C. at 5.2 mbar. In doing so, a liquid residue of 4.5% was obtained and there was a condensation loss of 1.0%. 94.5% was obtained as a permanently clear bidistillate. By increasing the evaporator temperature to 220° C., the liquid residue was reduced to 1.1%, resulting in a product of 97.9% as permanently clear bidistillate.

The invention claimed is:

1. A method for stabilizing hydrocarbon products obtained from depolymerization of hydrocarbon-containing residues or pyrolysis oil wherein said hydrocarbon products are obtained by (i) providing hydrocarbon-containing residues or pyrolysis oil; (i) heating said hydrocarbon-containing residues or pyrolysis oil in a reactor to create a hydrocarbon-containing vapor fraction; and (ii) distilling said hydrocarbon-containing vapor fraction to obtain a clear or substantially clear liquid of diesel oil fraction or heating oil fraction; the improvement comprising:

a) exposing said clear or substantially clear liquid of diesel oil fraction or heating oil fraction to an oxidative atmosphere and causing said clear or substantially clear liquid of diesel oil fraction or heating oil fraction to become discolored; and, b) clarifying said discolored diesel oil fraction or heating oil fraction in a distillation column or in a thin-layer evaporator to obtain a clear liquid of stabilize diesel oil or stabilized heating oil, said step of clarifying said discolored diesel oil fraction or heating oil fraction occurs in said thin-layer evaporator, said discolored diesel oil fraction or heating oil fraction is passed as a thin layer over an evaporator surface that is at a temperature of about 180-240° C. and then a vapor component that is formed is condensed to form said clear liquid of stabilized diesel oil or stabilized heating oil.

2. The method as defined in claim 1, wherein said thin-layer evaporation takes place at a pressure of about 1-500 mbar absolute.

3. The method as defined in claim 2, wherein said thin-layer evaporation takes place at a pressure of about 2-100 mbar absolute.

4. The method as defined in claim 1, wherein said discolored diesel oil fraction or heating oil fraction is passed as a thin layer over an evaporator surface that is at a temperature of about 200-230° C. and at a pressure of about 2-100 mbar absolute.

5. The method as defined in claim 4, wherein said discolored diesel oil fraction or heating oil fraction is passed as a thin layer over an evaporator surface that is at a temperature of about 210-220° C. and at a pressure of about 5.2 mbar absolute.

6. The method as defined in claim 1, including the step of transferring said clear or substantially clear liquid of diesel oil fraction or heating oil fraction to a storage tank and delaying said discolorization of said clear or substantially clear liquid of diesel oil fraction or heating oil fraction in said storage tank by preventing said clear or substantially clear liquid of diesel oil fraction or heating oil fraction to contact light while in said storage tank and subjecting said clear or substantially clear liquid of diesel oil fraction or heating oil fraction to a protective gas while in said storage tank.

7. The method as defined in claim 1, wherein said step of exposing said clear or substantially clear liquid of diesel oil fraction or heating oil fraction to an oxidative atmosphere includes bubbling one or more oxidative fluid through said clear or substantially clear liquid of diesel oil fraction or heating oil fraction to thereby agitate said clear or substantially clear liquid of diesel oil fraction or heating oil fraction and to accelerate said discoloring of said clear or substantially clear liquid of diesel oil fraction or heating oil fraction.

8. The method as defined in claim 1, wherein said step of clarifying said discolored diesel oil fraction or heating oil fraction occurs in said distillation column, said discolored diesel oil fraction or heating oil fraction is heated in said distillation column at a temperature of 350-390° C., said clear liquid of stabilized diesel oil or stabilized heating oil is drawn off said distillation column at a temperature of about 280-320° C.

9. The method as defined in claim 8, wherein said step of clarifying said discolored diesel oil fraction or heating oil fraction occurs in said distillation column, said discolored diesel oil fraction or heating oil fraction is heated in said distillation column at a temperature of 360-380° C., said clear liquid of stabilized diesel oil or stabilized heating oil is drawn off said distillation column at a temperature of about 280-320° C.

10. The method as defined in claim 8, wherein clear liquid of stabilized diesel oil or stabilized heating oil is drawn off said distillation column at a temperature of about 290-310° C.

* * * * *